US006627009B1

(12) United States Patent
Matsui et al.

(10) Patent No.: US 6,627,009 B1
(45) Date of Patent: Sep. 30, 2003

(54) EXTRAFINE COPPER ALLOY WIRE, ULTRAFINE COPPER ALLOY WIRE, AND PROCESS FOR PRODUCING THE SAME

(75) Inventors: Hakaru Matsui, Ibaraki (JP); Takaaki Ichikawa, Ibaraki (JP); Seigi Aoyama, Ibaraki (JP); Koichi Tamura, Ibaraki (JP); Osamu Seya, Ibaraki (JP); Hiroshi Komuro, Ibaraki (JP); Ryohei Okada, Ibaraki (JP); Shigetoshi Goto, Ibaraki (JP)

(73) Assignee: Hitachi Cable Ltd., Tokyo (JP)

( * ) Notice: Subject to any disclaimer, the term of this patent is extended or adjusted under 35 U.S.C. 154(b) by 0 days.

(21) Appl. No.: 09/714,669

(22) Filed: Nov. 17, 2000

(30) Foreign Application Priority Data

Nov. 19, 1999 (JP) ..... 11-330012

(51) Int. Cl.[7] ..... C22C 9/02
(52) U.S. Cl. ..... 148/433; 148/436
(58) Field of Search ..... 148/433, 436, 148/432

(56) References Cited

FOREIGN PATENT DOCUMENTS

| | | | |
|---|---|---|---|
| JP | 01147032 | * | 6/1989 |
| JP | 2267811 | * | 11/1990 |
| JP | 2270212 | * | 11/1990 |
| JP | 02278608 | * | 11/1990 |
| JP | 04146210 | | 5/1992 |
| JP | 4259343 | * | 9/1992 |
| JP | 5311283 | * | 11/1993 |
| JP | 05311283 | * | 11/1993 |

* cited by examiner

*Primary Examiner*—Sikyin Ip
(74) *Attorney, Agent, or Firm*—Antonelli, Terry, Stout & Kraus, LLP

(57) ABSTRACT

In an extrafine or ultrafine copper alloy wire having an outer diameter of not more than 0.1 mm, the copper alloy wire is formed of a heat treated copper alloy comprising 0.05 to 0.9% by weight in total of at least one metallic element selected from the group consisting of tin, indium, silver, antimony, magnesium, aluminum, and boron and not more than 50 ppm of oxygen with the balance consisting of copper. By virtue of this constitution, the extrafine or ultrafine copper alloy wire has a combination of excellent bending fatigue lifetime based on high tensile strength and excellent torsional strength based on high elongation or a combination of excellent tensile strength, electrical conductivity, and drawability and good elongation. The invention has been described in detail with particular reference to preferred embodiments, but it will be understood that variations and modifications can be effected within the scope of the invention as set forth in the appended claims.

2 Claims, 3 Drawing Sheets

EXTRAFINE COPPER ALLOY WIRE, ULTRAFINE COPPER ALLOY WIRE, AND PROCESS FOR PRODUCING THE SAME

FIELD OF THE INVENTION

The invention relates to an extrafine copper alloy wire, an ultrafine copper alloy wire, and a process for producing the same, and more particularly to an extrafine copper alloy wire, with an outer diameter of 0.02 to 0.1 mm, possessing excellent bending fatigue lifetime and torsional strength and an ultrafine copper alloy wire, with a wire diameter of not more than 0.08 mm, possessing excellent tensile strength, electrical conductivity, and drawability and good elongation, and a process for producing the same.

BACKGROUND OF THE INVENTION

A reduction in size of electronic equipment, IC testers, medical ultrasound system and the like has led to an ever-increasing demand for a reduction in diameter of electric wires for use in these types of equipment. In general, conductor wires for electric wires used in this field are classified into three groups, that is, products having an outer diameter of more than 0.1 mm, products having an outer diameter of 0.02 to 0.1 mm, and products having an outer diameter of less than 0.02 mm.

For conductor wires having an outer diameter exceeding 0.1 mm, importance is attached to torsional properties and elongation from the viewpoint of preventing loosening of wires, for example, during twisting work or working of terminals. In general, for this application, annealed tough pitch copper (TPC), which is advantageous from the viewpoints of low price and good electrical conductivity, has been used.

For conductor wires having an outer diameter of less than 0.02 mm, wires are highly likely to be broken during extrusion of an insulator due to the very small diameter. For this reason, a copper-tin alloy is used which possesses excellent tensile strength and flexing resistance although the copper-tin alloy has somewhat low electrical conductivity.

For extrafine conductor wires having an intermediate size, that is, an outer diameter of 0.02 to 0.1 mm, annealed TPC is used when twistability, workability of terminals, and high electrical conductivity are required, while wire drawn product of copper-tin alloys are used when flexing resistance is required.

According to the conventional extrafine conductor wires having an intermediate size, however, the strength of the annealed TPC is so low that the bending fatigue lifetime is unsatisfactory, while, when the wire drawn products of copper-tin alloys are used, the elongation and torsional strength are so low that there is a high fear of wires being loosened, for example, during twisting work or working of terminals of electric wires.

In the case of electric wires for medical ultrasound system, there is a demand for electric wires (cables) which have an increased number of wire cores (micro coaxial cables) while maintaining the outer diameter of conventional electric wires.

To this end, high strength, high flexing resistance, high electrical conductivity, good twistability, and good workability of terminals are required of conductors for electric wires. In this case, importance is attached to high strength, flexing resistance, and high electrical conductivity among these property requirements, and, at the present time, electric wires using a hard material of a dilute copper alloy as the conductor constitute the mainstream of electric wires for medical ultrasound system.

This electric wire for medical ultrasound system comprises a large number of ultrafine copper alloy wires stranded together. The ultrafine copper alloy wire is produced by melting a dilute copper alloy, casting the molten alloy into a wire rod, and then drawing the wire rod through a die to a diameter of 0.03 mmϕ.

When an ultrafine copper alloy wire having a smaller diameter (for example, not more than 0.025 mmϕ) is used as a conductor for electric wires from the viewpoint of further reducing the diameter of electric wires for medical ultrasound system, however, excessively low breaking strength of the conductors using the conventional copper alloy causes frequent wire breaks at the time of wire drawing or stranding of the conductors. For this reason, the formation of ultrafine copper alloy wires having a diameter of not more than 0.025 mmϕ using conventional alloys was very difficult.

Thus, ultrafine copper alloy wires having higher tensile strength have been desired. Merely increasing the tensile strength, however, results in lowered electrical conductivity. This has led to a demand for copper alloys having both high tensile strength and high electrical conductivity.

Further, excellent drawability is required for the formation of ultrafine copper alloy wires having a diameter of not more than 0.025 mmϕ. When a wire rod is drawn by dicing, the presence of foreign materials having a size of about one-third of the wire diameter in the wire rod poses a problem of wire breaks. Therefore, the amount of foreign materials contained in the wire rod should be reduced to improve the wire drawability.

Detailed analysis of the foreign materials contained in a sample of a broken wire has revealed that the cause of the inclusion of foreign materials in the wire rod is classified roughly into two routes. One of them is inclusions contained in the copper alloy as a base material and the metallic elements as the additive, and peeled pieces produced by the separation of refractories such as SiC, $SiO_2$, and $ZrO_2$, which are components of ceramics and cement used in crucibles employed in melting and/or molds used in casting. The other route is foreign materials externally included during wire drawing. Among these foreign materials, the inclusion of the latter type of foreign materials can be reduced by performing the step of wire drawing in a clean environment.

On the other hand, improving the quality of the base material (improving the purity of substances constituting the base material) is necessary for reducing the amount of the former type of foreign materials (inclusions and peeled pieces). Therefore, when ultrafine wires are formed by wire drawing, very careful attention should be paid so as to avoid the inclusion of foreign materials in steps from melting to wire drawing, and the factor in the inclusion of the foreign material should be minimized.

Further, in the case of ultrafine copper alloy wires having a diameter of not more than 0.025 mmϕ, the twistability and the workability of terminals, that is, elongation, in addition to the tensile strength and the electrical conductivity, become important.

SUMMARY OF THE INVENTION

The invention has been made with a view to solving the above problems of the prior art, and it is an object of the invention to provide an extrafine copper alloy wire, with an outer diameter of 0.02 to 0.1 mm, possessing excellent bending fatigue lifetime based on high tensile strength and excellent torsional strength based on high elongation, and a process for producing the extrafine copper alloy wire.

It is another object of the invention to provide an ultrafine copper alloy wire possessing excellent tensile strength, electrical conductivity, and drawability and, at the same time, good elongation, and a process for producing the ultrafine copper alloy wire.

The features of the invention will be summarized below.

(1) An extrafine copper alloy wire comprising a copper alloy wire having an outer diameter of 0.02 to 0.1 mm, said copper alloy wire being formed of a heat treated copper alloy comprising 0.1 to 0.9% by weight of tin and not more than 50 ppm of oxygen with the balance consisting of copper.

In this feature of the invention, the content of tin is limited to 0.1 to 0.9% by weight. When the tin content is less than 0.1% by weight, the strength is unsatisfactory and, in its turn, the bending fatigue lifetime is unsatisfactory. On the other hand, when the tin content exceeds 0.9% by weight, the elongation is unsatisfactory. This results in lowered torsional strength and, thus, causes a problem of loosening of wires at the time of stranding or working of terminals in electric wires.

The content of oxygen is limited to not more than 50 ppm. When the oxygen content exceeds 50 ppm, an oxide of tin is produced and, thus, the amount of the tin component dissolved in copper to form a solid solution is unsatisfactory.

(2) The extrafine copper alloy wire according to item (1), wherein said copper alloy wire has a bending fatigue lifetime of not less than 4,000 times as measured by repeatedly flexing a sample of the copper alloy wire in the right direction at an angle of 90° and in the left direction at an angle of 90° and a flexing strain of 0.8% while applying a load corresponding to 20% of the breaking load, and a torsional strength of not less than 250 times as measured by stranding a sample of the copper alloy wire while applying a load corresponding to 1% of the breaking load.

(3) An extrafine copper alloy wire comprising a copper alloy wire having an outer diameter of 0.02 to 0.1 mm, said copper alloy wire being formed of a heat treated copper alloy comprising 0.1 to 0.9% by weight of tin, 0.1 to 0.5% by weight of indium, and not more than 50 ppm of oxygen with the balance consisting of copper.

(4) The extrafine copper alloy wire according to item (3), wherein said copper alloy wire has a bending fatigue lifetime of not less than 4,000 times as measured by repeatedly flexing a sample of the copper alloy wire in the right direction at an angle of 90° and in the left direction at an angle of 90° and a flexing strain of 0.8% while applying a load corresponding to 20% of the breaking load, and a torsional strength of not less than 250 times as measured by stranding a sample of the copper alloy wire while applying a load corresponding to 1% of the breaking load.

Indium has the effect of further improving the bending fatigue lifetime and the torsional strength. In order to attain this effect, the indium content should be at least 0.1% by weight. On the other hand, the upper limit of the indium content should be 0.5% by weight. The addition of indium in an amount exceeding 0.5% by weight should be avoided because the elongation and the torsional strength are deteriorated although the strength and the bending fatigue lifetime are increased.

The presence of unavoidably included impurities besides the above-described tin, oxygen, and indium poses no problem, and other constituents may be added so far as they are not detrimental to the object of the invention.

(5) A process for producing an extrafine copper alloy wire, comprising the steps of:

drawing a copper alloy to produce a wire having an outer diameter of 0.02 to 0.1 mm, the copper alloy comprising 0.1 to 0.9% by weight of tin and not more than 50 ppm of oxygen with the balance consisting of copper; and then heat treating the wire at 500 to 800° C.

In this production process, the heat treatment temperature is limited to 500 to 800° C. When the heat treatment temperature is below 500° C., a lot of time is required for the heat treatment. Therefore, the cost is increased, and, thus, the profitability is lost. On the other hand, when the heat treatment temperature is above 800° C., the resultant extrafine copper wire is soft and thus is likely to be broken during working of wires in the production of electric wires.

(6) The process according to item (5), wherein the heat treatment is carried out by traveling the wire through a tubular furnace heated at a predetermined temperature.

Preferably, the heat treatment is carried out by continuously traveling the wire through a tubular heating furnace. Unlike the conventional heat treatment method wherein the wire is wound around a bobbin and, in this state, heat treated, according to this method, for example, seizing or adhesion between wires does not occur, and, in addition, heat can be homogeneously applied to the wires, thus realizing the production of homogeneous extrafine copper wires. The inside of the tubular heating furnace is preferably filled with inert gas such as nitrogen or argon gas.

(7) A process for producing an extrafine copper alloy wire, comprising the steps of:

drawing a copper alloy to produce a wire having an outer diameter of 0.02 to 0.1 mm, the copper alloy comprising 0.1 to 0.9% by weight of tin, 0.1 to 0.5% by weight of indium, and not more than 50 ppm of oxygen with the balance consisting of copper; and then heat treating the wire at 500 to 800° C.

(8) The process according to item (7), wherein the heat treatment is carried out by traveling the wire through a tubular heating furnace heated at a predetermined temperature.

The extrafine copper alloy wires according to the invention have the following properties.

Specifically, the extrafine copper alloy wires according to the invention are characterized by having a bending fatigue lifetime of not less than 4,000 times as measured by repeatedly flexing a vertically suspended sample of the extrafine copper alloy wire in the right direction at an angle of 90° and in the left direction at an angle of 90° and a flexing strain of 0.8% while applying a load corresponding to 20% of the breaking load of the copper alloy wire to the sample, and having a torsional strength of not less than 250 times in terms of the number of times of torsion required for causing wire breaks as measured by stranding the upper end of a sample of the extrafine copper alloy wire in one direction while applying a load corresponding to 1% of the breaking load of the copper alloy wire to the lower end of the sample.

The bending fatigue lifetime of not less than 4,000 times is a precondition for a guarantee for the flexing properties of this type of extrafine copper alloy wires having an outer diameter of 0.02 to 0.1 mm. On the other hand, the torsional strength of not less than 250 times in terms of the number of times of torsion is also important for preventing wires from loosening, for example, during stranding or working of terminals of electric wires.

Further, the extrafine copper alloy wires according to the invention are characterized by having a tensile strength of not less than 40 kgf/mm$^2$, an elongation of not less than 8%, and an electrical conductivity of not less than 70% IACS.

When the tensile strength is less than 40 kgf/mm$^2$, it is difficult to ensure the bending fatigue lifetime of not less than 4,000 times. When the elongation is less than 8%, it is difficult to ensure the torsional strength of not less than 250 times. When the electrical conductivity is less than 70% IACS, the electrical loss is unfavorably increased in signal wire applications.

(9) An ultrafine copper alloy wire formed of an alloy comprising a copper matrix of high purity copper with a total unavoidable impurity content of not more than 1 ppm and, contained in the matrix, 0.05 to 0.9% by weight of at least one metallic element selected from the group consisting of tin, indium, silver, antimony, magnesium, aluminum, and boron, said wire having been drawn to a final diameter of not more than 0.08 mm and annealed.

The total content of the unavoidable impurities in the high purity copper is limited to not more than 1 ppm from the viewpoint of minimizing the content of inclusions in the copper matrix. More specifically, a major part of the unavoidable impurities is accounted for by oxygen (O), and this oxygen combines with copper contained in the copper matrix to form a compound ($Cu_2O$) which becomes inclusions having a particle diameter of about 2 $\mu$mm. In general, the particle diameter of inclusions causative of wire breaks is said to be not less than about one-third of the wire diameter. There is a possibility that even inclusions having a smaller particle diameter cause wire breaks. For this reason, the total content of the unavoidable impurities in the high purity copper is limited to not more than 1 ppm.

The amount of the metallic element contained in the copper matrix in the high purity copper is limited to 0.05 to 0.9% by weight. When the amount of the metallic element contained in the copper matrix is less than 0.05% by weight, a tensile strength of 300 to 500 MPa cannot be ensured. On the other hand, the amount of the metallic element is larger than 0.9% by weight, an electrical conductivity of not less than 70% IACS cannot be ensured.

(10) An ultrafine copper alloy wire comprising:

a core wire formed of an alloy comprising a copper matrix of high purity copper with a total unavoidable impurity content of not more than 1 ppm and, contained in the matrix, 0.05 to 0.9% by weight of at least one metallic element selected from the group consisting of tin, indium, silver, antimony, magnesium, aluminum, and boron, said wire having been drawn to a final diameter of not more than 0.08 mm and annealed; and, provided on the periphery of the core wire, a tin plating, a silver plating, a nickel plating, a tin-lead solder plating, a tin-copper-bismuth-base lead-free solder plating, or a tin-silver-copper-base lead-free solder plating.

The diameter of the ultrafine copper alloy wire after drawing is limited to not more than 0.08 mm. When the wire diameter is larger than 0.08 mm, even conventional materials can stably provide extrafine copper alloy wires.

(11) A process for producing an ultrafine copper alloy wire, comprising the steps of:

performing melting and casting respectively using a carbon crucible and a carbon mold to form a wire rod formed of an alloy comprising a copper matrix of high purity copper with a total unavoidable impurity content of not more than 1 ppm and, contained in the matrix, 0.05 to 0.9% by weight of at least one metallic element selected from the group consisting of tin, indium, silver, antimony, magnesium, aluminum, and boron;

drawing the wire rod to form a wire having a final diameter of not more than 0.08 mm; and then annealing the wire.

The material constituting the crucible and the mold should be a carbon, from the viewpoint of avoiding the inclusion of pieces peeled from the crucible and the mold in the molten metal and the cast material during melting and casting.

The reason why the annealing treatment is carried out while traveling the wire is that, when a wire wound around an iron bobbin is placed in a furnace to perform annealing, there is a fear of causing adhesion between wires, leading to a problem of quality.

(12) The process according to item (11), wherein the annealing of the wire is carried out by traveling the drawn wire through a tubular furnace having an atmosphere of reducing gas including a mixed gas composed of argon gas and hydrogen gas.

(13) The process according to item (11), wherein the annealing of the wire is carried out by electric heating.

(14) The process according to item (11), which further comprises the step of forming a tin plating, a silver plating, a nickel plating, a tin-lead solder plating, a tin-copper-bismuth-base lead-free solder plating, or a tin-silver-copper-base lead-free solder plating on the periphery of the annealed wire as the core wire.

(15) An electric wire comprising a plurality of ultrafine copper alloy wires stranded together, said ultrafine copper alloy wires each being formed of an alloy comprising a copper matrix of high purity copper with a total unavoidable impurity content of not more than 1 ppm and, contained in the matrix, 0.05 to 0.9% by weight of at least one metallic element selected from the group consisting of tin, indium, silver, antimony, magnesium, aluminum, and boron, said wire having been drawn to a final diameter of not more than 0.08 mm and annealed.

(16) An electric wire comprising a plurality of ultrafine copper alloy wires stranded together, said ultrafine copper alloy wires each comprising: a core wire formed of an alloy comprising a copper matrix of high purity copper with a total unavoidable impurity content of not more than 1 ppm and, contained in the matrix, 0.05 to 0.9% by weight of at least one metallic element selected from the group consisting of tin, indium, silver, antimony, magnesium, aluminum, and boron, said wire having been drawn to a final diameter of not more than 0.08 mm and annealed; and, provided on the periphery of the core wire, a tin plating, a silver plating, a nickel plating, a tin-lead solder plating, a tin-copper-bismuth-base lead-free solder plating, or a tin-silver-copper-base lead-free solder plating.

(17) An extrafine copper alloy wire comprising a copper alloy wire having an outer diameter of not more than 0.1 mm, said copper alloy wire being formed of a heat treated copper alloy comprising 0.05 to 0.9% by weight in total of at least one metallic element selected from the group consisting of tin, indium, silver, antimony, magnesium, aluminum, and boron and not more than 50 ppm of oxygen with the balance consisting of copper.

(18) A micro coaxial cable comprising:

an inner conductor comprising a plurality of extrafine or ultrafine copper alloy wires, according to item (1), (3), (9), (10), or (17), stranded together;

an insulation covering the inner conductor;

an outer conductor comprising a plurality of extrafine or ultrafine copper alloy wires spirally wound on the insulation at predetermined pitches; and a jacket as the outermost layer of the micro coaxial cable.

(19) The micro coaxial cable according to item (18), wherein the extrafine or ultrafine copper alloy wire constituting the outer conductor is one according to item (1), (3), (9), (10), or (17).

BRIEF DESCRIPTION OF THE DRAWINGS

The invention will be described in more detail in conjunction with the accompanying drawings, wherein.

DESCRIPTION OF THE PREFERRED EMBODIMENTS

Preferred embodiments of the invention will be described.

Extrafine Copper Alloy Wires and Process for Producing the Same

EXAMPLE A

Production of Extrafine Copper Alloy Wires

EXAMPLES A1 to A4

Predetermined amounts of tin were added to and dissolved in oxygen-free copper (OFC), followed by continuous casting and rolling to produce wire rods having an outer diameter of 11 mm. These wire rods were then drawn to an outer diameter of 2.6 mm. The drawn wires were then annealed by electric heating to produce wires having an outer diameter of 0.08 mm.

Next, these wires were subjected to respective predetermined heat treatments in a nitrogen gas atmosphere. Thus, four types of extrafine copper alloy wires having an oxygen content of 30 ppm with varied tin content were produced.

Figure 1:
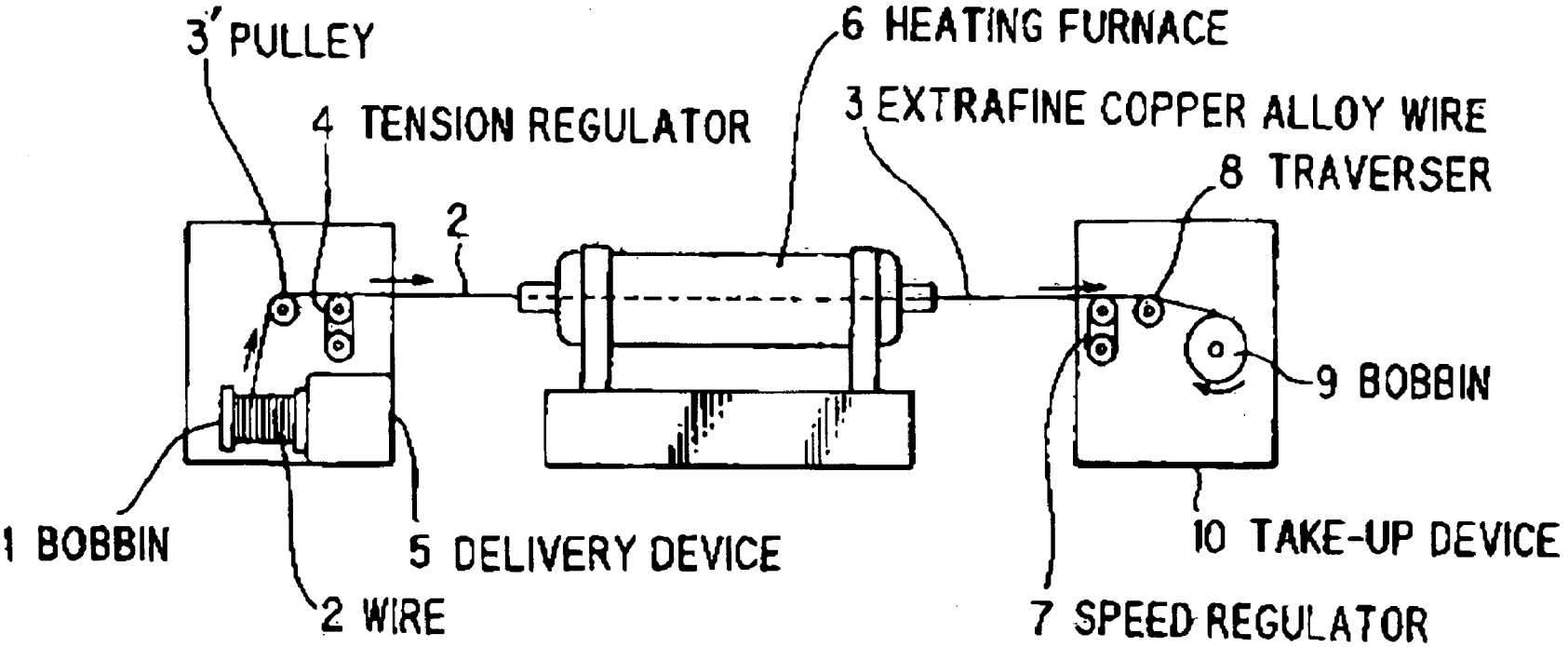
FIG. 1 is a diagram illustrating the construction of a heat treatment apparatus used in a preferred embodiment of the production process of an extrafine copper alloy wire according to the invention.

FIG. 1 shows a heat treatment apparatus used in the heat treatment of wires. The heat treatment apparatus comprises: a delivery device 5 for delivering a wire 2 wound around a bobbin 1 through a pulley 3' and a tension regulator 4 under a predetermined tension; a tubular heating furnace 6 which allows the wire 2 delivered from the delivery device 5 to continuously travel through the interior thereof to heat the wire 2 to a predetermined temperature; and a take-up device 10 for winding the heat-treated wire (extrafine copper alloy wire 3) around a bobbin 9 through a speed regulator 7 and a traverser 8.

Nitrogen gas is continuously fed into the heating furnace 6, and the wire 2 is passed through the heating furnace 6 provided with an effective soaking zone having a length of 600 mm (temperature distribution ±1° C.) at a speed of 42.5 m/min. Thus, extrafine copper alloy wires 3 of Examples A1 to A4 were produced.

For the examples, the tin content and the heat treatment temperature in the heating furnace 6 were as follows.

Example A1: tin 0.15 wt %, heat treatment temperature 550° C.

Example A2: tin 0.2 wt %, heat treatment temperature 600° C.

Example A3: tin 0.3 wt %, heat treatment temperature 700° C.

Example A4: tin 0.7 wt %, heat treatment temperature 800° C.

EXAMPLES A5 and A6

Predetermined extrafine copper alloy wires were produced in the same manner as in Examples A1 to A4, except that additives to OFC, the amounts of the additives to OFC, and the heat treatment temperature in the heating furnace 6 were as follows.

Example A5: tin 0.1 wt %, indium 0.2 wt %, heat treatment temperature 600° C.

Example A6: tin 0.2 wt %, indium 0.2 wt %, heat treatment temperature 700° C.

COMPARATIVE EXAMPLES A1 to A3

Extrafine copper wire and extrafine copper alloy wires of comparative examples were produced in the same manner as in Examples A1 to A4, except that additives to OFC, the amounts of the additives to OFC, and the heat treatment temperature in the heating furnace 6 were as follows.

Comparative Example A1: no additive, heat treatment temperature 600° C.

Comparative Example A2: tin 2.0 wt %, heat treatment temperature 800° C.

Comparative Example A3: tin 0.2 wt %, indium 2.0 wt %, heat treatment temperature 800° C.

The extrafine copper alloy wires and extrafine copper wire prepared in the above examples and comparative examples were tested for properties. The results are summarized in Table A1.

TABLE A1

| | Bending fatigue lifetime | Torsional strength | Tensile strength, kgf/mm$^2$ | Elongation, % | Electrical conductivity, % IACS |
|---|---|---|---|---|---|
| Ex. | | | | | |
| A1 | ○ | ◎ | 40.2 | 12.0 | 89.0 |
| A2 | ○ | ◎ | 40.8 | 11.5 | 84.9 |
| A3 | ◎ | ○ | 41.3 | 10.6 | 79.8 |
| A4 | ◎ | ○ | 43.0 | 8.5 | 72.0 |
| A5 | ○ | ○ | 40.5 | 11.0 | 90.3 |
| A6 | ◎ | ○ | 42.3 | 8.8 | 84.2 |
| Comp. Ex. | | | | | |
| A1 | x | ◎ | 27.0 | 21.0 | 101.0 |
| A2 | ◎ | x | 53.0 | 2.5 | 38.0 |
| A3 | ◎ | x | 48.0 | 1.9 | 80.4 |

Figure 2:
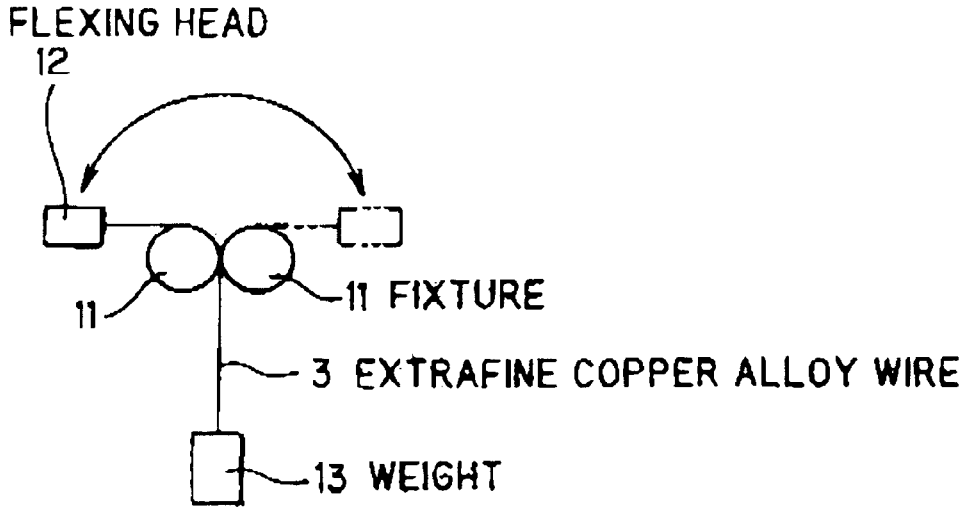
FIG. 2 is a diagram illustrating a testing apparatus used in the measurement of a bending fatigue lifetime.

FIG. 2 schematically shows a testing apparatus used in the measurement of a bending fatigue lifetime. An extrafine copper alloy wire (or an extrafine copper wire for Comparative Example A1; the same shall apply hereinafter) 3 is vertically suspended between a pair of left and right flexing fixtures 11. The upper end of the extrafine copper alloy wire 3 is fixed to a flexing head 12, and a weight 13 having a weight corresponding to 20% of breaking load of the extrafine copper alloy wire 3 is mounted onto the lower end of the extrafine copper alloy wire 3. In this state, the extrafine copper alloy wire 3 was flexed in the left direction at an angle of 90° and in the right direction at an angle of 90° with the flexing fixtures 11 functioning as the fulcrum at a flexing strain of 0.8% by the pendular action of the flexing head 12. In this way, the life test was carried out.

In this case, the bending fatigue lifetime was determined in terms of the number of flexes required for causing breaking of the extrafine copper alloy wire 3. When the number of flexes does not reach 4,000 times, the bending fatigue lifetime was evaluated as X; when the number of flexes was not less than 4,000 times, the bending fatigue lifetime was evaluated as ○; and when the number of flexes were not less than 5,000 times, the bending fatigue lifetime was evaluated as ◎. The results are summarized in Table A1.

Figure 3:
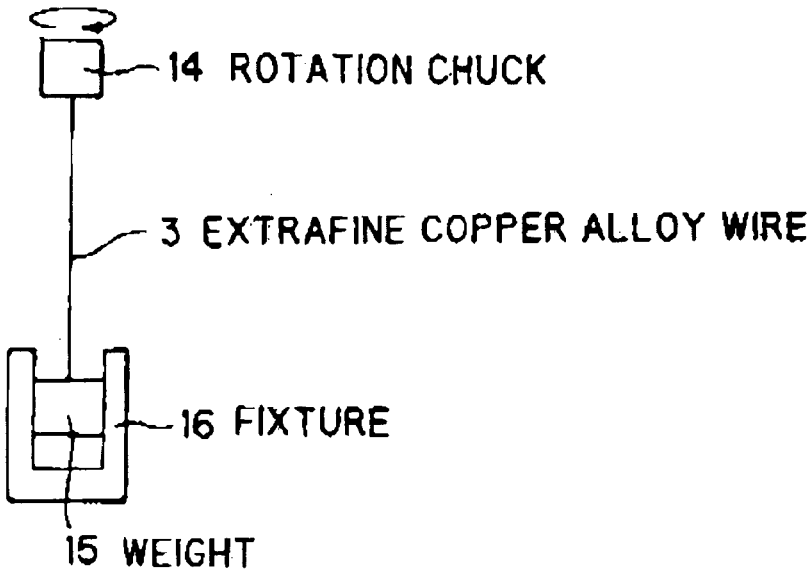
FIG. 3 is a diagram illustrating a testing apparatus used in the measurement of a torsional strength.

FIG. 3 schematically shows a testing apparatus for measuring the torsional strength. The upper end of the extrafine copper alloy wire 3 is fixed to a rotation chuck 14. A weight 15 having a weight corresponding to 1% of the breaking load of the extrafine copper alloy wire 3 is mounted onto the lower end of the extrafine copper alloy wire 3. The rotation chuck 14 was rotated in a direction indicated by an arrow. In this case, the number of time of torsion by the rotation chuck 14 required for causing breaking of the extrafine copper alloy wire 3 was determined. The torsional strength was expressed in terms of the number of times of torsion. Numeral 16 designates a fixture for preventing the rotation of the weight 15. In Table A1, X represents that the number of times of torsion was less than 250; ○ represents that the number of times of torsion was not less than 250; and ◎ represents that the number of times of torsion was not less than 350.

As is apparent from Table A1, for the extrafine copper alloy wires of Examples A1 to A6, both the bending fatigue lifetime and the torsional strength were evaluated as ◎ or ○, whereas, for the extrafine copper wire and extrafine copper alloy wires produced in Comparative Examples A1 to A3, the bending fatigue lifetime or the torsional strength was evaluated as X. Thus, there was a significant difference in bending fatigue lifetime and torsional strength between the extrafine copper alloy wires of the examples and the extrafine copper wire and extrafine copper alloy wires of the comparative examples.

The above results are also supported by the tensile strength and the elongation. Specifically, the extrafine copper, alloy wires produced in Examples A1 to A6 had a tensile strength of not less than 40 kgf/mm$^2$ and an elongation of not less than 8%. By contrast, the extrafine copper wire produced in Comparative Example A1 had very low tensile strength, and the extrafine copper alloy wires produced in Comparative Examples A2 and A3 also had low elongation. Thus, the extrafine copper wire and extrafine copper alloy wires produced in Comparative Examples A1 to A3 cannot be put to practical use without difficulties. In particular, for the extrafine copper alloy wire produced in Comparative Example A2, the electrical conductivity was also very low.

This significant superiority of properties of the products of the examples to the products of the comparative examples is derived from the effect of the invention attained by specifying the tin content and the oxygen content in respective content ranges or adding a specific amount of indium to this composition and performing heat treatment.

As is apparent from the foregoing description, for the extrafine copper alloy wire and the process for producing the same according to the invention, in an extrafine copper alloy wire having an outer diameter of 0.02 to 0.1 mm, the heat treatment of a wire formed of a copper alloy comprising 0.1 to 0.9% by weight of tin and not more than 50 ppm of oxygen with the balance consisting of copper or comprising 0.1 to 0.5% by weight of indium in addition to the above constituents with the balance consisting of copper can provide extrafine copper alloy wires possessing excellent bending fatigue lifetime based on high tensile strength and excellent torsional strength based on high elongation. Thus, the invention is very useful, for example, for providing conductor wires for electronic equipment or electric wires for medical ultrasound system.

Ultrafine Copper Alloy Wires and Process for Producing the Same

One preferred embodiment of the ultrafine copper alloy wire according to the invention will be described.

A preferred embodiments of the ultrafine copper alloy wire according to the invention is formed of an alloy (high purity copper alloy) comprising a copper matrix of high purity copper with a total unavoidable impurity content of not more than 1 ppm and, contained in the matrix, 0.05 to 0.9% by weight, preferably 0.05 to 0.7% by weight, of at least one metallic element selected from the group consisting of tin, indium, silver, antimony, magnesium, aluminum, and boron, the wire having been drawn to a diameter of not more than 0.08 mm, preferably not more than 0.025 mm, and annealed, the ultrafine copper alloy wire having a tensile strength of 300 to 500 MPa, an electrical conductivity of not less than 70% IACS, and an elongation of 5 to 15%.

In this preferred embodiment, the tensile strength is limited to 300 to 500 MPa. When the tensile strength is less than 300 MPa, due to the very small wire diameter, the wires cannot withstand the stress applied at the time of stranding of wires or at the time of extrusion coating of an insulator, leading to a fear of wire breaks. Further, the bending fatigue lifetime is likely to be unsatisfactory for use as conductors. On the other hand, when the tensile strength exceeds 500 MPa, the elongation is as low as about 2%. This leads to a fear of troubles at the time of stranding of wires or working of terminals.

The electrical conductivity should be not less than 70% IACS. When the electrical conductivity is less than 70% IACS, the transmission loss is large at the time of the flow of a high frequency current.

The elongation is limited to 5 to 15%. When the elongation is less than 5%, there is a fear of troubles at the time of stranding of wires or working of terminals. On the other hand, when the elongation exceeds 15%, the tensile strength is as low as less than 300 MPa and, thus, the flexing resistance is likely to be unsatisfactory.

A wire having a tensile strength of not less than 700 MPa and an electrical conductivity of not less than 70% IACS can be provided by specifying the metallic element contained in the copper matrix and the content of the metallic element to the type and content range described above.

The use of a high purity copper having a total unavoidable impurity content of not more than 1 ppm as a material for constituting the copper matrix can reduce the content of the foreign materials in wires formed of the high purity copper alloy as compared with the content of foreign materials in wires formed of the conventional oxygen-free copper alloy. Therefore, ultrafine copper alloy wires having good drawability can be realized.

According to the invention, drawing a wire having a tensile strength of not less than 700 MPa and an electrical conductivity of not less than 70% IACS and possessing good drawability to a final diameter of not more than 0.08 mm, preferably not more than 0.025 mm, followed by annealing, can provide an ultrafine copper alloy wire having a tensile strength of 300 to 500 MPa, an electrical conductivity of not less than 70% IACS, and an elongation of 5 to 15%.

Next, the production process according to the invention will be described.

At the outset, a high purity copper having a total unavoidable impurity content of not more than 1 ppm is melted in a carbon crucible. At least one metallic element selected from the group consisting of tin, indium, silver, antimony, magnesium, aluminum, and boron is then added to the molten high purity copper to prepare a molten high purity copper alloy wherein the content of the metallic element in the copper matrix has been regulated to 0.05 to 0.9% by weight, preferably 0.05 to 0.7% by weight.

The molten high purity copper alloy is then poured into a carbon mold and is continuously cast into a wire rod.

Next, the wire rod is subjected to primary wire drawing. The drawn wire is then annealed. The annealed drawn wire is subjected to secondary wire drawing to prepare a wire having a diameter of not more than 0.08 mm, preferably not more than 0.025 mm.

Finally, this wire is traveled through a heating furnace having a reducing gas atmosphere of a mixed gas composed of argon gas and hydrogen gas to anneal the wire, thereby producing an ultrafine copper alloy wire.

Here the carbon crucible and the carbon mold are not limited to crucibles and molds which are entirely constituted by graphite, and, of course, include crucibles and molds wherein only the surface of them is covered with graphite, crucibles and molds which are entirely formed of a carbon fiber or a carbon fiber sheet, and crucibles and molds wherein only the surface of them is covered with a carbon fiber or a carbon fiber sheet.

The reducing gas is not particularly limited to the mixed gas composed of argon gas and hydrogen gas, and any of the commonly used reduced gases may be used.

The temperature within the heating furnace is, for example, 500 to 700° C., more preferably about 600° C.

The annealing treatment method is not particularly limited to one wherein the wire is traveled through a heating furnace having a reducing gas atmosphere, and any of the methods commonly used in the annealing treatment, for example, electric heating, may be used.

In the process for producing an ultrafine copper alloy wire according to the invention, the use of the carbon crucible and the carbon mold respectively in melting of a high purity copper alloy and casting of a molten high purity copper alloy can avoid unfavorable phenomenon, which is often found in the prior art technique, that is, the inclusion of peeled pieces of refractories constituting the crucible and/or the mold in the molten high purity copper alloy during melting and casting. This can provide a wire having high tensile strength and high electrical conductivity and, at the same time, good drawability.

The drawing of this wire to a final diameter followed by annealing can improve the elongation and the electrical conductivity although the tensile strength is lowered, as compared with the wire before the annealing. This can realize an ultrafine copper alloy wire having good twistability and good working of terminals.

Next, another preferred embodiment of the invention will be described.

The ultrafine copper alloy wire according to another preferred embodiment of the invention is produced as follows.

At the outset, a wire is formed using an alloy comprising a copper matrix of high purity copper with a total unavoidable impurity content of not more than 1 ppm and, contained in the matrix, 0.05 to 0.9% by weight, preferably 0.05 to 0.7% by weight, of at least one metallic element selected from the group consisting of tin, indium, silver, antimony, magnesium, aluminum, and boron.

Next, this wire is drawn to a diameter of not more than 0.08 mm, preferably not more than 0.025 mm. The drawn wire is then annealed to form a core wire.

Thereafter, a tin plating, a silver plating, a nickel plating, a tin-lead solder plating, a tin-copper-bismuth-base lead-free solder plating, or a tin-silver-copper-base lead-free solder plating is formed on the periphery of the core wire. Thus, an ultrafine copper alloy wire of this preferred embodiment is produced.

Here the plating may be formed by any method without particular limitation, that is, by any of methods commonly used in plating.

This preferred embodiment can, of course, offer substantially the same effect as the first preferred embodiment of the invention, and the tensile strength or the electrical conductivity can be further improved according to the properties required of the ultrafine copper alloy wire.

An electric wire using an ultrafine copper alloy wire according to a preferred embodiment of the invention is produced as follows.

At the outset, a wire is formed using an alloy comprising a copper matrix of high purity copper with a total unavoidable impurity content of not more than 1 ppm and, contained in the matrix, 0.05 to 0.9% by weight, preferably 0.05 to 0.7% by weight, of at least one metallic element selected from the group consisting of tin, indium, silver, antimony, magnesium, aluminum, and boron.

Next, this wire is drawn to a diameter of not more than 0.08 mm, preferably not more than 0.025 mm. The drawn wire is then annealed to form an ultrafine copper alloy wire.

Finally, a plurality of the ultrafine copper alloy wires are stranded together to produce an electric wire using an ultrafine copper alloy wire according to this preferred embodiment.

According to this preferred embodiment, an electric wire can be realized wherein, despite the same outer diameter as the conventional electric wires, the number of wire cores is larger than that of the conventional electric wires. That is, an electric wire having higher density can be realized.

An electric wire using an ultrafine copper alloy wire according to a further preferred embodiment of the invention is produced as follows.

At the outset, a wire is formed using an alloy comprising a copper matrix of high purity copper having a total unavoidable impurity content of not more than 1 ppm and, contained in the matrix, 0.05 to 0.9% by weight, preferably 0.05 to 0.7% by weight, of at least one metallic element selected from the group consisting of tin, indium, silver, antimony, magnesium, aluminum, and boron.

Next, this wire is drawn to a diameter of not more than 0.08 mm, preferably not more than 0.025 mm, and then annealed to form a core wire.

Thereafter, a tin plating, a silver plating, a nickel plating, a tin-lead solder plating, a tin-copper-bismuth-base lead-free solder plating, or a tin-silver-copper-base lead-free solder plating is formed on the periphery of the core wire. Thus, an ultrafine copper alloy wire is produced.

Finally, a plurality of the ultrafine copper alloy wires are stranded together to produce an electric wire using an ultrafine copper alloy wire according to this preferred embodiment.

The electric wire according to this embodiment can, of course, offer substantially the same effect as the electric wire according to the preferred embodiment described just above, and the tensile strength or the electrical conductivity can be further improved according to the strength required at the time of the production of electric wires or the properties required of electric wires.

EXAMPLE B

Production of Ultrafine Copper Alloy Wires

EXAMPLE B1

A high purity copper having a copper content of 99.9999% by weight and a total unavoidable impurity content of 0.5 ppm was pickled with acid, and then placed within a carbon crucible, followed by vacuum melting in a small continuous casting system. Upon complete melting of copper, the atmosphere in the chamber was replaced by argon gas, and metallic elements were added to the crucible.

After the added metallic elements were completely dissolved in the molten copper, the molten metal was held for several minutes, and then continuously cast using a carbon mold into a wire rod having a chemical composition of copper—0.20 tin—0.20 indium and a diameter of 8.0 mmϕ. The wire rod was subjected to primary wire drawing to prepare a wire material having a diameter of 0.9 mmϕ which was then annealed.

The annealed wire material was then subjected to secondary wire drawing to form a wire having a diameter of 0.02 mmϕ. The drawn wire was then heated to 600° C., and the single wire was traveled through a tubular furnace having a mixed gas atmosphere composed of argon gas and hydrogen gas to anneal the wire. Thus, an ultrafine copper alloy wire was produced.

EXAMPLE B2

An ultrafine copper alloy wire was prepared in the same manner as in Example B1, except that a wire rod having a chemical composition of copper—0.30 tin and a diameter of 8.0 mmϕ was prepared.

EXAMPLE B3

An ultrafine copper alloy wire was prepared in the same manner as in Example B1, except that a high purity copper having a copper content of 99.9999% by weight and a total unavoidable impurity content of 0.5 ppm was used to prepare a wire rod having a chemical composition of copper—0.60 indium and a diameter of 8.0 mmϕ.

EXAMPLE B4

An ultrafine copper alloy wire was prepared in the same manner as in Example B1, except that a wire rod having a chemical composition of copper—0.20 silver and a diameter of 8.0 mmϕ was prepared.

EXAMPLE B5

An ultrafine copper alloy wire was prepared in the same manner as in Example B1, except that a high purity copper having a copper content of 99.9999% by weight and a total unavoidable impurity content of 0.7 ppm was used to prepare a wire rod having a chemical composition of copper—0.1 antimony and a diameter of 8.0 mmϕ.

EXAMPLE B6

An ultrafine copper alloy wire was prepared in the same manner as in Example B1, except that a wire rod having a chemical composition of copper—0.03 tin—0.02 magnesium and a diameter of 8.0 mmϕ was prepared.

EXAMPLE B7

An ultrafine copper alloy wire was prepared in the same manner as in Example B1, except that a wire rod having a chemical composition of copper—0.30 tin—0.02 aluminum and a diameter of 8.0 mmϕ was prepared.

EXAMPLE B8

An ultrafine copper alloy wire was prepared in the same manner as in Example B1, except that a high purity copper having a copper content of 99.9999% by weight and a total unavoidable impurity content of 0.7 ppm was used to prepare a wire rod having a chemical composition of copper—0.20 magnesium—0.1 zinc and a diameter of 8.0 mmϕ.

EXAMPLE B9

An ultrafine copper alloy wire was prepared in the same manner as in Example B1, except that a high purity copper having a copper content of 99.9999% by weight and a total unavoidable impurity content of 0.6 ppm was used to prepare a wire rod having a chemical composition of copper—0.30 tin—0.02 boron and a diameter of 8.0 mmϕ.

COMPARATIVE EXAMPLE B1

An oxygen-free copper having a copper content of 99.99% by weight and a total unavoidable impurity content of 14.0 ppm was placed within an SiC crucible, followed by melting in the air. After copper was completely melted, metallic elements were added to the crucible.

After the added metallic elements were completely dissolved in the molten copper, the molten metal was held for several minutes, and then continuously cast by SCR and rolled to produce a wire rod having a chemical composition of copper—0.19 tin—0.20 indium and a diameter of 11.0 mmϕ. The wire rod was scalped, and then subjected to primary wire drawing to prepare a wire material having a diameter of 0.9 mmϕ which was then annealed by electric heating.

The annealed drawn wire material was then subjected to secondary wire drawing to prepare a wire having a diameter of 0.02 mmϕ. Thereafter, the drawn wire was heated to 600° C., and the single wire was traveled through a tubular furnace having a mixed gas atmosphere composed of argon gas and hydrogen gas to anneal the wire. Thus, an ultrafine copper alloy wire was produced.

COMPARATIVE EXAMPLE B2

An ultrafine copper alloy wire was prepared in the same manner as in Comparative Example B1, except that an oxygen-free copper having a copper content of 99.99% by weight and a total unavoidable impurity content of 18.0 ppm was used to prepare a wire rod having a chemical composition of copper—0.30 tin and a diameter of 11.0 mmϕ.

COMPARATIVE EXAMPLE B3

An ultrafine copper alloy wire was prepared in the same manner as in Comparative Example B1, except that an oxygen-free copper having a copper content of 99.99% by weight and a total unavoidable impurity content of 20.0 ppm was used to prepare a wire rod having a chemical composition of copper—2.0 tin and a diameter of 11.0 mmϕ.

COMPARATIVE EXAMPLE B4

An ultrafine copper alloy wire was prepared in the same manner as in Comparative Example B1, except that an oxygen-free copper having a copper content of 99.99% by weight and a total unavoidable impurity content of 0.6 ppm was used to prepare a wire rod having a chemical composition of copper—0.02 tin and a diameter of 11.0 mmϕ.

Data (chemical composition (wt %) and total content (ppm) of unavoidable impurities in copper material (copper as raw material)) on the ultrafine copper alloy wires prepared in Examples B1 to B9 and Comparative Examples B1 to B4 are summarized in Table B1.

TABLE B1

| | Items | Chemical composition, wt % | | | | | | | | | Total content of unavoidable impurities in Cu material, ppm |
|---|---|---|---|---|---|---|---|---|---|---|---|
| | | Sn | In | Ag | Sb | Mg | Al | Zn | B | Cu | |
| Ex. | B1 | 0.20 | 0.20 | — | — | — | — | — | — | Balance | 0.5 |
| | B2 | 0.30 | — | — | — | — | — | — | — | Balance | 0.5 |
| | B3 | — | 0.60 | — | — | — | — | — | — | Balance | 0.6 |
| | B4 | — | — | 0.20 | — | — | — | — | — | Balance | 0.5 |
| | B5 | — | — | — | 0.10 | — | — | — | — | Balance | 0.7 |
| | B6 | 0.03 | — | — | — | 0.02 | — | — | — | Balance | 0.5 |
| | B7 | 0.30 | — | — | — | — | 0.02 | — | — | Balance | 0.5 |
| | B8 | — | — | — | — | 0.20 | — | 0.10 | — | Balance | 0.7 |
| | B9 | 0.30 | — | — | — | — | — | — | 0.02 | Balance | 0.6 |
| Comp. Ex. | B1 | 0.19 | 0.20 | — | — | — | — | — | — | Balance | 14.0 |
| | B2 | 0.30 | — | — | — | — | — | — | — | Balance | 18.0 |
| | B3 | 2.00 | — | — | — | — | — | — | — | Balance | 20.0 |
| | B4 | 0.02 | — | — | — | — | — | — | — | Balance | 0.6 |

Next, the ultrafine copper alloy wires prepared in Examples B1 to B9 and Comparative Examples B1 to B4 were evaluated for tensile strength (MPa), elongation (%), electrical conductivity (% IACS), and drawability, and, in addition, the overall evaluation for these properties was carried out. The results are summarized in Table B2.

In the evaluation of the drawability, 1 kg of a base material for each of the ultrafine copper alloy wires was subjected to wire drawing. When the base material was drawn to a length of not less than 50,000 m without breaking, the wire drawability was evaluated as ○, whereas, when breaking occurred before the length reached 50,000 m, the wire drawability was evaluated as Δ.

TABLE B2

| | Items | | | | |
|---|---|---|---|---|---|
| | Tensile strength, MPa | Elongation, % | Electrical conductivity, % IACS | Wire drawability | Overall evaluation |
| Ex. | | | | | |
| B1 | 380 | 10.0 | 80.7 | ○ | ○ |
| B2 | 380 | 9.8 | 78.3 | ○ | ○ |
| B3 | 386 | 8.1 | 89.0 | ○ | ○ |
| B4 | 370 | 12.0 | 98.5 | ○ | ○ |
| B5 | 400 | 9.2 | 79.9 | ○ | ○ |
| B6 | 360 | 14.1 | 91.8 | ○ | ○ |
| B7 | 360 | 13.5 | 77.0 | ○ | ○ |
| B8 | 410 | 6.3 | 80.2 | ○ | ○ |
| B9 | 355 | 14.3 | 77.6 | ○ | ○ |

TABLE B2-continued

| | Items | | | | |
|---|---|---|---|---|---|
| | Tensile strength, MPa | Elongation, % | Electrical conductivity, % IACS | Wire drawability | Overall evaluation |
| Comp. Ex. | | | | | |
| B1 | 790 | 1.4 | 78.5 | Δ | x |
| B2 | 295 | 18.0 | 78.5 | Δ | x |

TABLE B2-continued

| | Items | | | | |
|---|---|---|---|---|---|
| | Tensile strength, MPa | Elongation, % | Electrical conductivity, % IACS | Wire drawability | Overall evaluation |
| B3 | 350 | 20.0 | 38.0 | Δ | x |
| B4 | 400 | 4.2 | 99.2 | ○ | x |

As shown in Table B2, all the ultrafine copper alloy wires prepared in Examples B1 to B9, wherein the content of unavoidable impurities in the copper material, the content of the metallic element, and the material for the crucible and the mold had been specified, had a tensile strength of 300 to 500 MPa, an elongation of 5 to 15%, an electrical conductivity of not less than 70% IACS, and good drawability.

On the other hand, for the ultrafine copper alloy wires prepared in Comparative Example B1, although the electrical conductivity was 78.5% IACS which satisfied the specified electrical conductivity range (not less than 70% IACS), the drawability was not good due to the fact that the total content of unavoidable impurities in the copper material was 14.0 ppm which was larger than the specified total unavoidable impurity content range (not more than 10 ppm). Further, due to the tensile strength (790 MPa) larger than the specified tensile strength range (300 to 500 MPa), the elongation was as low as 1.4%, and the elongation within the specified elongation range (5 to 15%) could not be ensured.

For the ultrafine copper alloy wire of Comparative Example B2 wherein the total content of unavoidable impurities in the copper material was 18.0 ppm which was larger than the specified unavoidable impurity content range although the electrical conductivity was 78.5% IACS which satisfied the specified electrical conductivity range, the drawability was not good. Further, due to the fact that the elongation was 18.0% which was larger than the specified elongation range, the tensile strength was as low as 295 MPa, and the tensile strength falling within the specified tensile strength range could not be ensured.

For the ultrafine copper alloy wire of Comparative Example B3 wherein the total content of unavoidable impurities in the copper material was 20.0 ppm which was larger than the specified unavoidable impurity content range and, in addition, the metallic element content was 2.00% by weight which was larger than the specified metallic element content range (0.05 to 0.9% by weight) although the tensile strength was 350 MPa which satisfied the specified tensile strength range, the electrical conductivity was as low as 36.0% IACS and, thus, the specified electrical conductivity range could not be ensured. Further, the drawability was not good, and the elongation was also as large as 20% which was larger than the specified elongation range.

The ultrafine copper alloy wire of Comparative Example B4 had a tensile strength of 400 MPa satisfying the specified tensile strength range and an electrical conductivity of 98.0% IACS satisfying the specified electrical conductivity range and, at the same time, had good drawability. Since, however, the metallic element content was 0.02% by weight which was smaller than the specified metallic element content range, the elongation was as low as 4.2%. That is, the specified elongation range could not be ensured.

Thus, the ultrafine copper alloy wires of Comparative Examples B1 to B4 were poor in at least one of the tensile strength, elongation, electrical conductivity, and drawability.

As is apparent from the foregoing description, ultrafine copper alloy wire and the process for producing the same according to the invention have the following excellent effects.

(1) Ultrafine copper alloy wires having excellent tensile strength, electrical conductivity, and drawability and, at the same time, good elongation can be realized by using a high purity copper having a total unavoidable impurity content of not more than 1 ppm and, in addition, specifying a metallic element added to a copper matrix and the content of the metallic element.

(2) The use of a carbon crucible and a carbon mold respectively in the melting of a high purity copper alloy and casting of the molten high purity copper alloy can avoid the inclusion of peeled pieces of the crucible and/or the mold in the molten high purity copper alloy during the melting and the casting.

EXAMPLE C

Production of Micro Coaxial Cables

EXAMPLE C1

Figure 4:
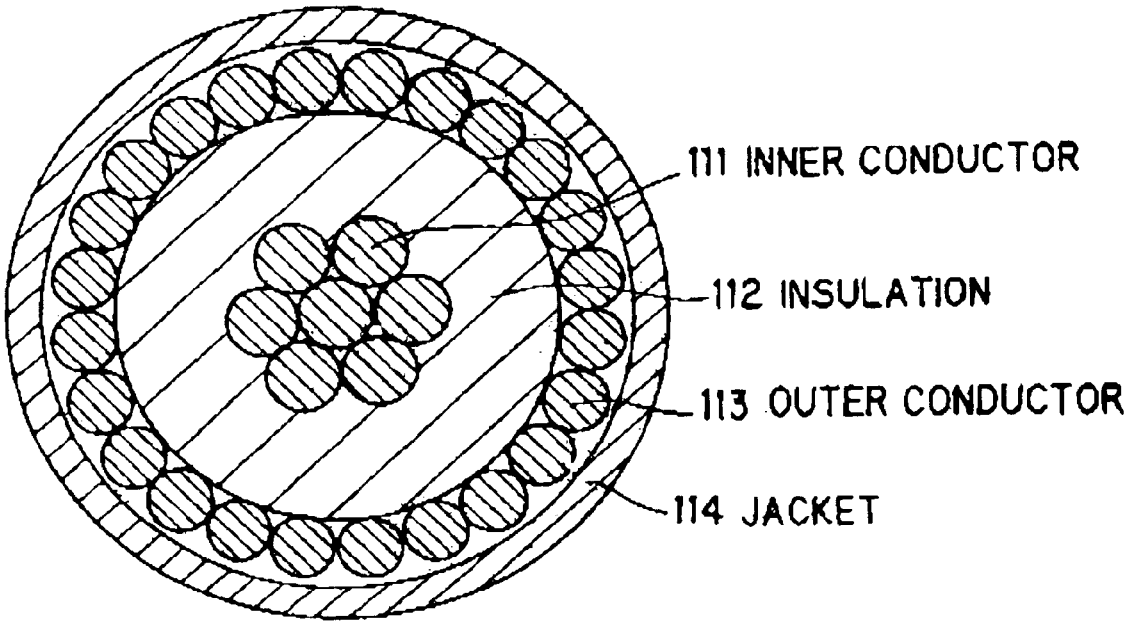
FIG. 4 is a diagram illustrating the construction of a micro coaxial cable using the extrafine or ultrafine copper alloy wire according to the invention.

A micro coaxial cable as shown in FIG. 4 was prepared as follows. In FIG. 4, numeral 111 designates an inner conductor, numeral 112 an insulation, numeral 113 an outer conductor, and numeral 114 a jacket.

An extrafine copper alloy wire was prepared in the same manner as in Example A1, except that the diameter of the extrafine copper alloy wire was 0.025 mm. Seven extrafine copper alloy wires of this type were stranded together to prepare a stranded wire. This stranded wire was used as the inner conductor 111. A fluororesin (FEP, PFA, or ETFE) was extruded onto the inner conductor 111 to form the insulation 112 having a thickness of 0.06 mm which covered the periphery of the inner conductor 111. 24 extrafine copper alloy wires having a diameter of 0.025 mm of the type prepared above were spirally wound around the insulation 112 at predetermined pitches to form the outer conductor 113. Next, a 0.02 mm-thick PET layer was covered as the jacket 114 on the outside of the outer conductor 113. Thus, a micro coaxial cable having an outer diameter of 0.274 mm could be prepared.

A metal tape layer (not shown) may be provided between the outer conductor 113 and the jacket 114. Extrafine copper alloy wires having an outer diameter of 0.015 to 0.03 mm, preferably 0.015 to 0.025 mm, may be used for constituting the inner conductor 111. Extrafine copper alloy wires having an outer diameter of 0.015 to 0.04 mm, preferably 0.015 to 0.025 mm, may be used for constituting the outer conductor 113. The outer diameter of the micro coaxial cable may be 0.15 to 0.3 mm.

EXAMPLE C2

The procedure of Example C1 was repeated, except that the extrafine copper alloy wires produced in Examples A2 to A6 and the ultrafine copper alloy wires produced in Examples B1 to B9 were used and the final diameter of the extrafine copper alloy wires and the ultrafine copper alloy wires was 0.025 mm. Thus, micro coaxial cables having an outer diameter of 0.274 mm could be prepared.

The invention has been described in detail with particular reference to preferred embodiments, but it will be understood that variations and modifications can be effected within the scope of the invention as set forth in the appended claims.

What is claimed is:

1. An extrafine copper alloy wire, comprising:

a copper alloy wire having an outer diameter of 0.02 to 0.1 mm;

said copper alloy wire being formed of a heat treated copper alloy comprising 0.1 to 0.9% by weight of tin and not more than 50 ppm of oxygen with the balance consisting of copper; and said copper alloy wire has a bending fatigue lifetime of not less than 4,000 times as measured by repeatedly flexing a sample of the copper alloy wire in the right direction at an angle of 90° and in the left direction at an angle of 90°, and a flexing strain of 0.8% while applying a load corresponding to 20% of the breaking load, and a torsional strength of not less than 250 times as measured by stranding a sample of the copper alloy wire while applying a load corresponding to 1% of the breaking load.

2. An extrafine copper alloy wire, comprising:

a copper alloy wire having an outer diameter of 0.02 to 0.1 mm;

said copper alloy wire being formed of a heat treated copper alloy comprising 0.1 to 0.9% by weight of tin, 0.1 to 0.5% by weight of indium, and not more than 50 ppm of oxygen with the balance consisting of copper; and said copper alloy wire has a bending fatigue lifetime of not less that 4,000 times as measured by repeatedly flexing a sample of the copper alloy wire in the right direction and the left direction at an angle of 90°, and a flexing strain of 0.8% while applying a load corresponding to 20% of the breaking load, and a torsional strength of not less than 250 times as measured by stranding a sample of the copper alloy wire while applying a load corresponding to 1% of the breaking load.

* * * * *